US006434926B1

(12) United States Patent
Dean et al.

(10) Patent No.: US 6,434,926 B1
(45) Date of Patent: Aug. 20, 2002

(54) COMBUSTION CHAMBER FOR GAS TURBINES

(75) Inventors: Anthony Dean, Scotia, NY (US); Luciano Mei; Alessio Miliani, both of Florence (IT)

(73) Assignee: Nuovo Pignone Holdings S.p.A., Florence (IT)

( * ) Notice: Subject to any disclaimer, the term of this patent is extended or adjusted under 35 U.S.C. 154(b) by 0 days.

(21) Appl. No.: 09/579,443

(22) Filed: May 26, 2000

(30) Foreign Application Priority Data

May 31, 1999 (IT) ..... MI99A1207

(51) Int. Cl.[7] ..... F02C 3/06

(52) U.S. Cl. ..... 60/39.36; 60/752; 60/39.31; 60/39.32

(58) Field of Search ..... 60/39.36, 39.31, 60/39.32, 752

(56) References Cited

U.S. PATENT DOCUMENTS 4,567,730 A * 2/1986 Scott ..... 60/757
4,843,825 A * 7/1989 Clark ..... 60/756
5,012,645 A 5/1991 Reynolds
5,480,162 A * 1/1996 Beeman, Jr. ..... 277/53
5,657,633 A * 8/1997 Brueggert ..... 60/747

* cited by examiner

*Primary Examiner*—Charles G. Freay
*Assistant Examiner*—William H Rodriguez
(74) *Attorney, Agent, or Firm*—Nixon & Vanderhye

(57) ABSTRACT

A combustion chamber for gas turbines comprises an inner liner (12) and an outer liner (11), wherein the inner liner (12) is substantially concentric relative to the outer liner (11), such as to define an annular inner space (30), and wherein a shield (13) is provided at the output of each of the burners. The specific feature of the invention consists in the fact that each of the shields (13) comprises a single metal plate part, and that the liners (11, 12) have a plurality of holes (20, 21), in sections adjacent to the longitudinal development of the shield (13), such as to define gaps (60, 61) for the circulation of air.

10 Claims, 3 Drawing Sheets

COMBUSTION CHAMBER FOR GAS TURBINES

BACKGROUND OF THE INVENTION

The present invention relates to a combustion chamber for gas turbines.

As is known, gas turbines are machines which consist of a compressor and of a turbine with one or more stages, wherein these components are connected to one another by a rotary shaft, and wherein a combustion chamber is provided between the compressor and the turbine.

In order to pressurise the compressor, it is supplied with air obtained from the external environment.

The compressed air passes through a series of pre-mixing chambers, which end in a nozzle or a converging portion, into each of which an injector supplies fuel which is mixed with the air, in order to form an air-fuel mixture to be burnt.

By means of one or more burners, supplied by a pressure network, there is admitted into the combustion chamber the fuel which is necessary in order to produce the combustion, which is designed to give rise to an increase in the temperature and enthalpy of the gas.

The known burners have a complex structure, inside which there is also present an injector for the liquid fuel, which in turn is contained inside an appropriately converging body, which in common technical language is generally known as the shroud, and is connected to a corresponding coupling, which permits connection to the combustion chamber.

Suitable turbulence in the flow of compressed air obtained from the compressor is created downstream of the injector, by associating with each burner an element which according to the art is generally known as the swirler, which intercepts the flow of air obtained from the compressor, and has a complex shape consisting of two series of blades oriented in opposite directions, all of which is designed to produce this turbulence.

The turbulence thus created makes it possible inter alia to mix the air itself satisfactorily with the fuel in the combustion chamber.

In order to improve the characteristics of stability of the flame, in the case of use of gaseous fuel, there is also generally provided a parallel fuel supply system, which can generate pilot flames in the vicinity of the output of the burner.

Finally, via corresponding ducts, the high-temperature, high-pressure gas reaches the various stages of the turbine, which transforms the enthalpy of the gas into mechanical energy which is available to a user.

If the area in which the combustion takes place is observed in greater detail, it can be seen that typically, the fuel is burnt in a combustion chamber which is delimited by what is generally known according to the art as an outer liner and an inner liner.

The inner liner is concentric relative to the outer liner, and co-operates with the latter such as to define an annular space which constitutes the actual combustion chamber.

As is known, in the design of combustion chambers for gas turbines, prevalence is given to considerations of stability of the flame and control of the excess air, in order to create the ideal conditions for combustion.

A second factor which affects the design of the combustion chambers of gas turbines is the tendency to make the combustion take place as much as possible in the vicinity of the dome of the combustion chamber.

Thus, in order to protect the combustion chamber against the high temperatures which exist during the combustion, it is known to provide a shield in the vicinity of the output of the burner.

However, owing to the high temperatures which the shield must withstand, it is necessary to provide a structure which can disperse the heat efficiently.

A known structure for shields of this type comprises a pair of metal plate parts, which are adjacent to one another and are separated by a plurality of contact elements, such as to define inner spaces which can permit good dispersion of heat.

However, it is known that although this structure fulfils satisfactorily its own technical function, it has a complex shape, consisting of several component parts, which must be assembled to one another.

SUMMARY OF THE PRESENT INVENTION

The object of the present invention is thus to provide a combustion chamber for gas turbines, which has shields which are produced simply and inexpensively, whilst being able to provide the required properties of protection against the heat of the flame.

Another object of the invention is to provide a combustion chamber for gas turbines, which can be produced at a low cost, and has a reduced number of component parts.

A further object of the invention is to provide a combustion chamber for gas turbines, which does not require costly modifications to the design of the conventional chambers.

This object and others are achieved by a combustion chamber for gas turbines, comprising an inner liner and an outer liner, wherein the inner liner is substantially concentric relative to the outer liner, such as to define an annular inner space, and wherein a shield is provided at the output of each of the burners, characterised in that each of the said shields comprises a single metal plate part, and in that at least one of the said liners has a plurality of holes, in sections adjacent to the longitudinal development of the said shield.

More particularly, in the combustion chamber for gas turbines according to the present invention, both the outer liner and the inner liner have a plurality of holes, in sections adjacent to the longitudinal development of the shield, such as to define corresponding gaps for circulation of air.

According to a preferred embodiment of the present invention, each of the shields consists of a body which has an upper wall, disposed adjacent to the drilled portion of the outer liner, and a lower wall, disposed adjacent to the drilled portion of the inner liner.

The upper wall of each shield is slightly convex, and has a surface which is larger than the corresponding lower wall of the shield, which in turn is slightly concave.

In addition, each shield is provided with a substantially cylindrical portion, which has a diameter slightly larger than the diameter of a corresponding raised portion for the converging output end of the corresponding burner, such as to assist perfect connection between these elements.

According to another preferred embodiment of the present invention, each shield has a plurality of projections, which are disposed both on the upper wall and on the lower wall, and can come into contact respectively with the outer liner and with the inner liner.

According to another preferred embodiment of the present invention, a substantially annular dome is provided in the upstream part of the combustion chamber, where it has a plurality of apertures, each of which is provided with a raised portion for the converging end of the corresponding burner.

In addition, the surface of the dome has a plurality of through holes, in order to increase the circulation of air on the shield.

Finally, each shield has a front wall, which connects the upper wall and the lower wall of the shield, and is adjacent to the drilled surface of the dome.

The combustion chamber for gas turbines according to the present invention makes it possible firstly to protect the dome, and the sections of the outer and inner liners which are most affected by the effects of the combustion, whilst avoiding excessive heating of the shield.

This result is obtained at extremely low costs, since the shield itself is produced in an extremely simple manner, by means of a single metal plate part.

In addition, in order to produce ducts for circulation of cooling air for the shield, it is sufficient to provide a plurality of holes along the surfaces of the inner liner and the outer liner, which operation clearly does not required particular additional costs.

Further characteristics of the invention are defined in the claims attached to the present patent application.

BRIEF DESCRIPTION OF THE DRAWING FIGURES

Further objects and advantages of the present invention will become apparent from the following description and the attached drawings, provided purely by way of non-limiting explanatory example, in which.

DETAILED DESCRIPTION OF THE INVENTION

With particular reference to the figures in question, the combustion chamber for gas turbines according to the present invention is indicated as a whole by the reference number 10.

Figure 1:
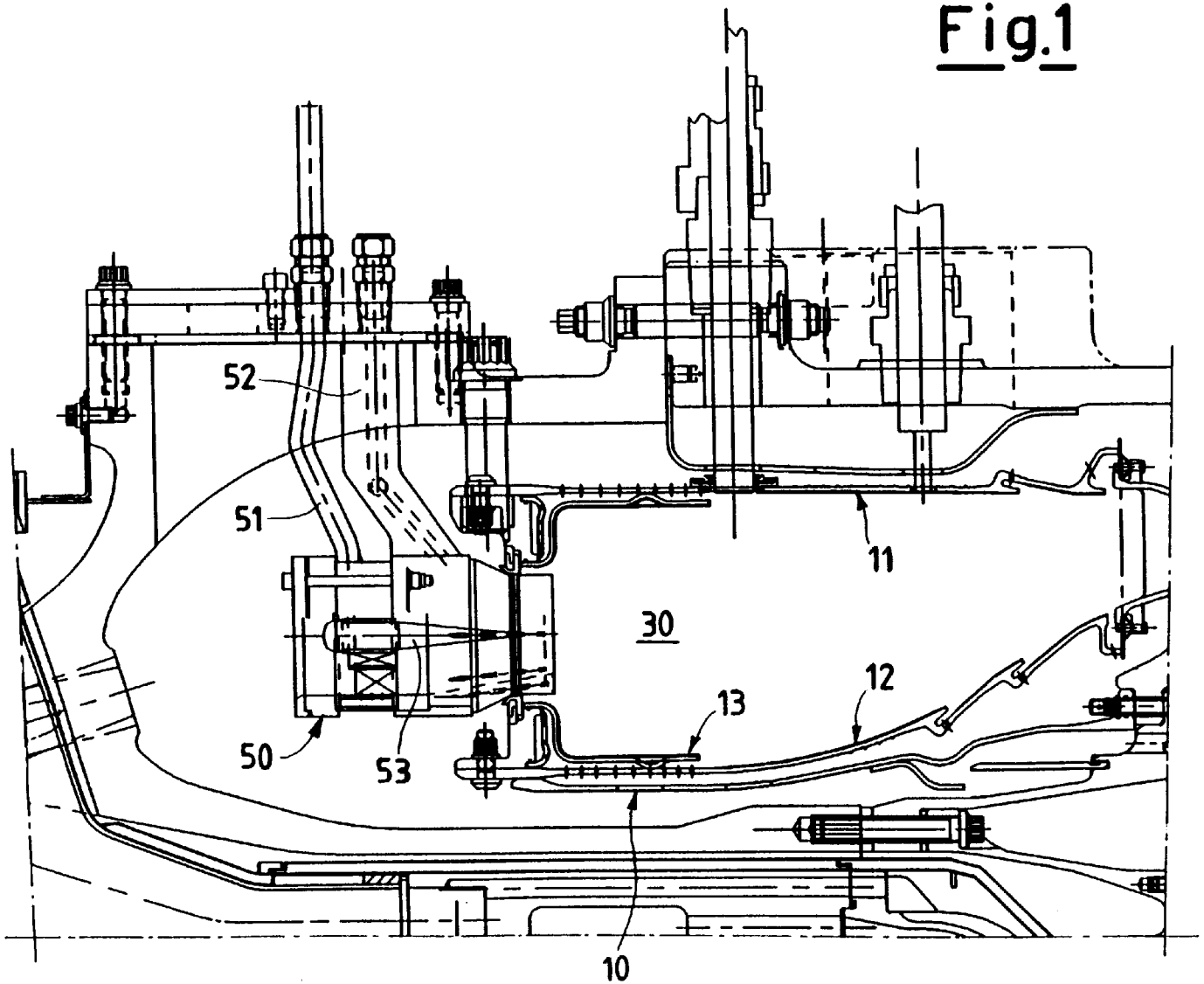
FIG. 1 is a view in cross-section of a detail of a gas turbine, showing an annular combustion chamber according to the present invention, with which a corresponding burner is associated.

In FIG. 1 there can be seen in cross-section a detail of a gas turbine, which shows the combustion chamber 10, with which the corresponding burner 50 is associated.

Supplied by a pressure network, each of the burners 50 receives the gaseous fuel which is necessary in order to produce the combustion, which gives rise to an increase in the temperature and enthalpy of the gas.

More particularly, the fuel is passed through a pipe 51, is discharged through corresponding holes (not shown), and is mixed with the air-fuel mixture obtained from the swirler, and with the air obtained from the injector 53 itself.

From the burner 50, and in particular from the pre-mixing chamber itself, the air-fuel mixture, formed as described, passes through the converging portion of the burner 50, into the combustion chamber 10, which is located downstream from the burner 50.

Incidentally, it should be noted that there is also provided a pipe 52, which is supplied with further gaseous fuel, which can generate pilot flames used to stabilise the main flame.

The flame is thus generated inside the combustion chamber 10, and is preferably kept in the vicinity of the dome 17 of the combustion chamber 10.

The combustion chamber 10 has an annular portion 30, which defines the actual combustion chamber, and is delimited radially by an inner liner 12, and an outer liner 11.

In fact, the inner liner 12 is substantially concentric relative to the outer liner 11, and consequently together they define an inner space with annular development, indicated in the figures by the reference number 30.

Figure 2:
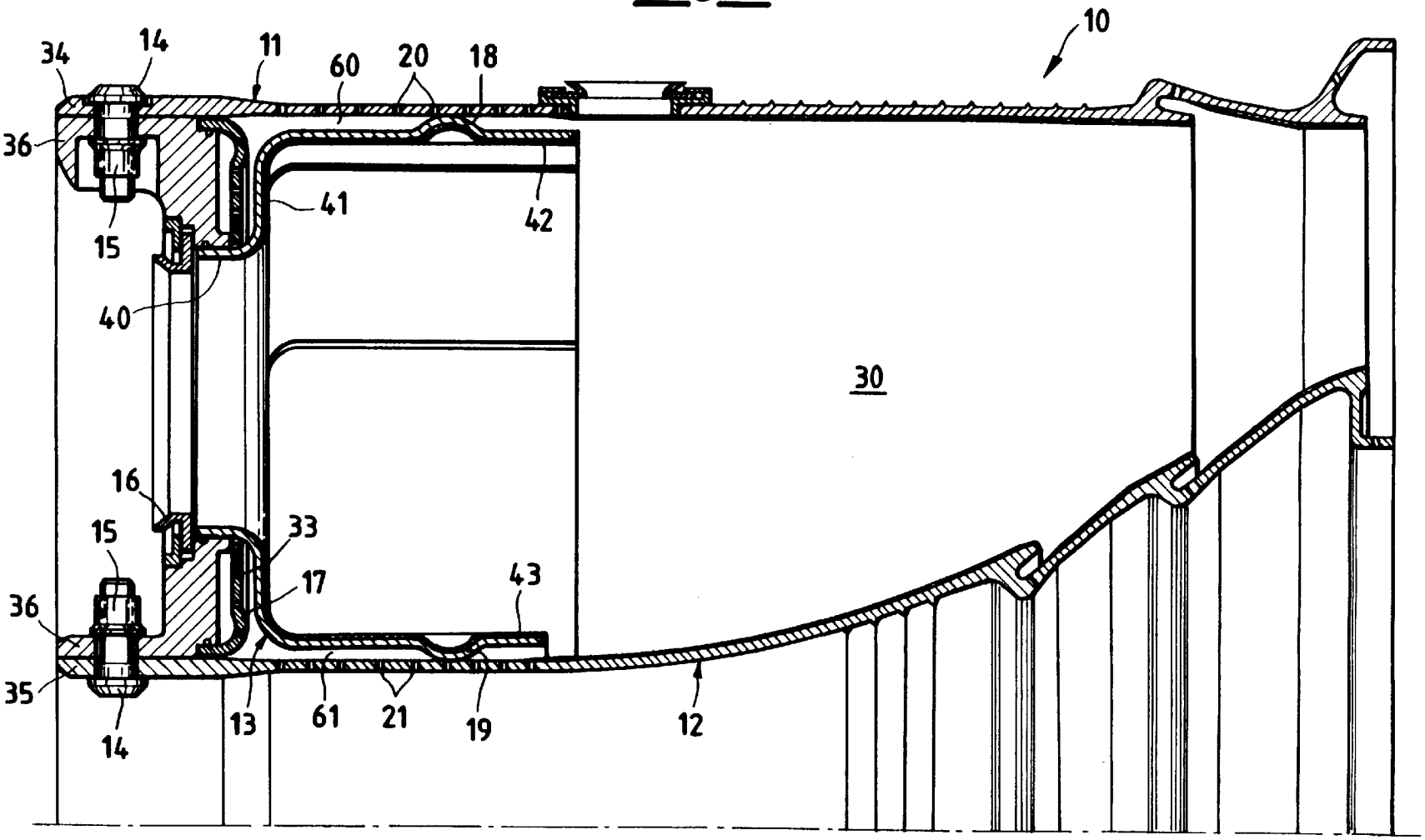
FIG. 2 is a view in cross-section of a combustion chamber according to the present invention.

As can be seen in FIG. 2, a dome 17, which is substantially circular, is provided in part of the combustion chamber 10, such as to be interposed between the burners 50 and the annular space 30, and is provided with a plurality of apertures along the entirety of its own circumference.

Each of these apertures is associated with a raised portion 16, in order to accommodate the converging end of a corresponding burner 50.

The surface of the dome 17 also has a plurality of through holes 33, which are provided in both sides of the apertures for the burners 50.

The outer liner 11 has an end portion 34, provided with corresponding holes, which, via a screw 14 which engages with a corresponding self-locking nut 15, are used to connect the outer liner 11 to an element 36, which contributes towards defining a raised portion 16 for the converging end of the corresponding burner 50.

Similarly, the inner liner 12 has an end portion 35, provided with corresponding holes, for connection of the outer liner 12, via a screw 14 which engages with a corresponding self-locking nut 15, to a corresponding element 36 which defines the raised portion 16.

There is also connected to the element 36 the dome 17, which on its exterior touches the outer liner 11 and the inner liner 12, and in its interior has a circular aperture which makes it possible to accommodate the end of a suitably shaped shield 13.

More particularly, the shield 13 comprises a single metal plate part, and is provided with a body which has an upper wall 42, disposed adjacent to a section of the outer liner 11, and a lower wall 43, disposed adjacent to a section of the inner liner 12.

Each of the shields 13 is provided with a substantially cylindrical portion 40, which has a diameter slightly larger than the diameter of the corresponding raised portion 16 for the converging output end of the corresponding burner So.

In addition, each of the shields 13 has a plurality of projections 18 and 19, which are disposed both on the upper wall 42 and on the lower wall 43 of the shield 13, and can come into contact respectively with the outer liner 11 and the inner liner 12.

Each of the shields 13 has a front wall 41, which connects the upper wall 42 and the lower wall 43 to one another.

This front wall 41 is adjacent to the drilled surface of the dome 17.

Figure 3:
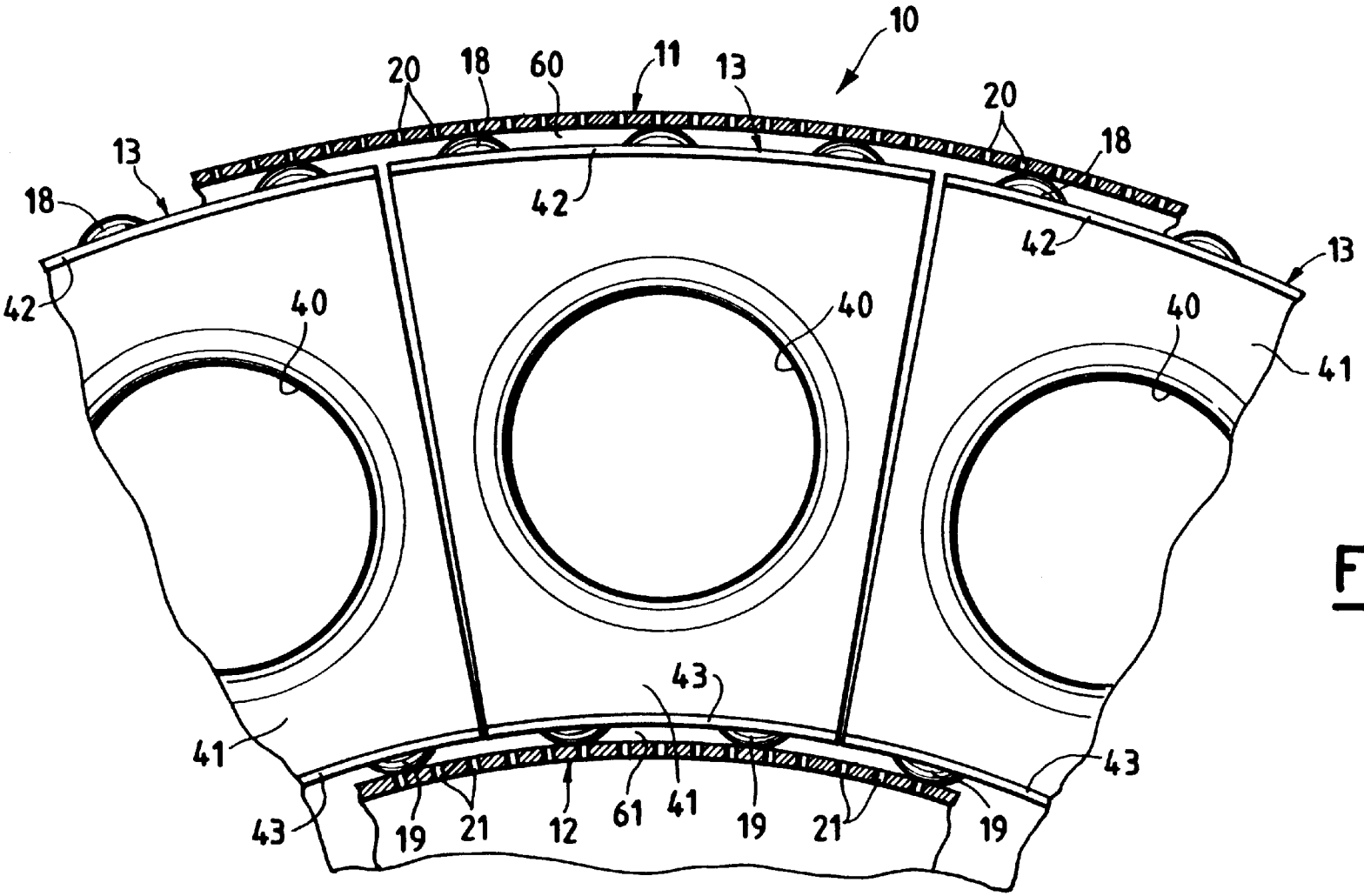
FIG. 3 is a front view, partially in cross-section, of a set of thermal shields which belong to the combustion chamber according to the invention.

FIG. 3 also shows the fact that the upper wall 42 of each of the shields 13 is slightly convex, and has a surface which is larger than the corresponding lower wall 43, which in turn is slightly concave.

A particularly important characteristic of the present invention consists in the fact that in the section adjacent to the longitudinal development of the shield 13, defined by the wall 42, the outer liner 11 has a plurality of so-called impingement holes 20.

Similarly, in the section adjacent to the longitudinal development of the shield 13, defined by the wall 43, the outer liner 11 has a plurality of impingement holes 21.

This arrangement of the liners 11 and 12 and of the walls 42 and 43 of the shield 17 makes it possible to define respectively a gap 60, which is contained between the outer liner 11 and the wall 42, and a gap 61, which is contained between the inner liner 12 and the wall 43, both of which can permit adequate circulation of air.

It should be noted that the number, dimensions and reciprocal spacing of the impingement holes 20 and 21 can be varied, according to the design requirements, without departing from the scope of the present invention.

The functioning and properties of the combustion chamber for gas turbines, according to the present invention, are described briefly hereinafter.

When the gas turbine is functioning, the compressor compresses the air taken from the external environment, which, as well as involving the burners 50, also circulates outside the combustion chamber 10.

In its path, this compressed air can also pass through the holes 20 and 21, which belong respectively to the outer liner 11 and the inner liner 12, and thus come into contact with the upper wall 42 and the lower wall 43 of the shield 17.

The contact of the air with these walls 42 and 43 thus contributes towards keeping the temperature of the shield 17 within an acceptable interval, despite the high temperatures reached by the gases in the combustion chamber 10.

This effect is increased by the fact that the upper wall 42 and the lower wall 43 of the shield 17 are disposed adjacent to the respective drilled portions of the liners 11 and 12, and thus at a minimum distance from the impingement holes 20 and 21.

The presence of the projections 18 and 19 allows the shield 17 to maintain contact with the outer liner 11 and the inner liner 12, in all the conditions of functioning of the turbine, whilst keeping the walls 42 and 43 at an appropriate distance from the liners 11 and 12, in order to permit circulation of air inside the gaps 60 and 61.

In addition, there is a given circulation of air owing to the presence of the through holes 33 provided in the surface of the dome 17.

The description provided makes apparent the characteristics and advantages of the combustion chamber for gas turbines which is the subject of the present invention.

Finally, it is apparent that many variants can be made to the combustion chamber for gas turbines which is the subject of the present invention, without departing from the principles of novelty which are inherent in the inventive concept, and it is also apparent that any materials, shapes and dimensions of the details illustrated can be used, as required, in the practical embodiment of the invention, and can be replaced by others which are technically equivalent.

What is claimed is:

1. A combustion chamber for a gas turbine comprising an inner liner and an outer liner, said inner liner being substantially concentric relative to the said outer liner and defining an annular inner space therewith, a shield at the output of each of a plurality of burners, and a dome upstream of the combustion chamber and the shields, each of the said shields including a single metal plate part having a surface spaced axially from said dome for protecting the dome from effects of combustion, each of said outer liner and said inner liners having a plurality of holes in portions thereof adjacent to longitudinal developments of said shields for cooling the shield, said liner portions and said shields defining gaps therebetween for circulation of air received through said holes enabling cooling of the shields by impingement and convection of air.

2. A combustion chamber for a gas turbine, according to claim 1 wherein each of said shields includes a body having an upper wall adjacent to a portion of said outer liner having said holes and a lower wall disposed adjacent to a portion of said inner liner having said holes.

3. A combustion chamber for a gas turbine, according to claim 2, wherein the upper wall of each of the said shields is convex, and has a surface which is larger than the corresponding lower wall, said lower wall being concave.

4. A combustion chamber for a gas turbine, according to claim 3, wherein each of said shields includes a substantially cylindrical portion having a diameter larger than the diameter of a corresponding raised portion of a converging output end of a corresponding burner.

5. A combustion chamber for a gas turbine, according to claim 4, wherein each of the said shields has a plurality of projections disposed on each of the upper wall and the lower wall for contact respectively with said outer liner and said inner liner.

6. A combustion chamber for a gas turbine, according to claim 1, wherein the dome has a plurality of apertures, each of which includes a raised portion to accommodate a converging end of a corresponding burner.

7. A combustion chamber for a gas turbine, according to claim 6, wherein the dome has a plurality of through holes for cooling portions of said shield.

8. A combustion chamber for a gas turbine, according to claim 6, wherein each of said shields includes an upper wall, a lower wall and a front wall connecting said upper wall and said lower wall, said front wall being disposed adjacent to said dome.

9. A combustion chamber for a gas turbine, according to claim 1, wherein both said outer liner and said inner liner have end portions, an element for accommodating a raised portion of a converging end of a corresponding burner, and fasteners for securing the end portions of said liners and the element to one another.

10. A combustion chamber for a gas turbine, according to claim 1, wherein the dome has a plurality of apertures, each of which includes a raised portion to accommodate a converging end of a corresponding burner, said dome having a plurality of through holes for cooling portions of said shield and each of said shields including an upper wall, a lower wall and a front wall connecting said upper wall and said lower wall, said front wall being disposed adjacent to said dome.

* * * * *

UNITED STATES PATENT AND TRADEMARK OFFICE

CERTIFICATE OF CORRECTION

PATENT NO. : 6,434,926 B1
DATED : August 20, 2002
INVENTOR(S) : Dean et al.

It is certified that error appears in the above-identified patent and that said Letters Patent is hereby corrected as shown below:

Column 4,
Line 45, kindly delete "corresponding burner So." and insert
-- corresponding burner 50. -- therefor.

Signed and Sealed this

Eighth Day of April, 2003

JAMES E. ROGAN
*Director of the United States Patent and Trademark Office*